US012303027B2

(12) United States Patent
Wallis

(10) Patent No.: US 12,303,027 B2
(45) Date of Patent: May 20, 2025

(54) STORAGE FURNITURE WITH TIP-OVER PREVENTION MECHANISM

(71) Applicant: Inter IKEA Systems B.V., Ln Delft (NL)

(72) Inventor: Fritz Wallis, Älmhult (SE)

(73) Assignee: Inter IKEA Systems B.V., Ln Delft (NL)

( * ) Notice: Subject to any disclaimer, the term of this patent is extended or adjusted under 35 U.S.C. 154(b) by 126 days.

(21) Appl. No.: 18/126,144

(22) Filed: Mar. 24, 2023

(65) Prior Publication Data

US 2024/0315443 A1 Sep. 26, 2024

(51) Int. Cl.
*A47B 67/04* (2006.01)

(52) U.S. Cl.
CPC ..... *A47B 67/04* (2013.01); *A47B 2220/0036* (2013.01)

(58) Field of Classification Search
CPC ..... A47B 67/04; A47B 2097/008; A47B 2220/0036
USPC ..... 312/245, 278
See application file for complete search history.

(56) References Cited

U.S. PATENT DOCUMENTS 3,700,300 A * 10/1972 Davis ..... F16B 12/20 312/257.1
4,863,132 A * 9/1989 Fitzgerald ..... A47B 97/00 248/231.91
5,277,487 A * 1/1994 Simon ..... A47B 67/00 29/434
5,700,293 A * 12/1997 Rydell ..... D06F 95/002 232/1 R
6,447,081 B1 * 9/2002 Sargeant ..... A47L 15/0084 312/228.1
9,504,323 B1 11/2016 Porreca
D805,322 S * 12/2017 Johanson ..... D6/559
2011/0121700 A1 * 5/2011 Porter ..... A47B 96/024 312/246
2017/0021958 A1 1/2017 Shelton
2018/0049548 A1 2/2018 Lercher

FOREIGN PATENT DOCUMENTS

FR 2594021 * 8/1987 ..... A47B 96/16
JP 5-176818 * 7/1993 ..... A47B 97/00

OTHER PUBLICATIONS

Form PCT/ISA/SO6 dated Jun. 25, 2024 for corresponding International Patent Application No. PCT/EP2024/057621 (11 pages).

* cited by examiner

*Primary Examiner* — James O Hansen
(74) *Attorney, Agent, or Firm* — Merchant & Gould P.C.

(57) ABSTRACT

A storage furniture is disclosed. The storage furniture includes a frame with a pair of side panels, each with a back end and a front end opposing the back end. At least one drawer is movable into and at least partly out of the frame when the at least one drawer is present in the frame. A fastener is configured to secure the frame to a vertical support when in an assembled orientation. The pair of side panels each have a top surface, and an opposing bottom surface in a facing relationship to a floor surface when in the assembled orientation. The bottom surface has a lesser front to back distance between the front end to the back end than the top surface.

16 Claims, 4 Drawing Sheets

STORAGE FURNITURE WITH TIP-OVER PREVENTION MECHANISM

TECHNICAL FIELD

The present disclosure generally relates to a storage furniture, and more particularly to a storage furniture with tip-over prevention mechanism that helps prevent the storage furniture from tipping over.

BACKGROUND

Storage furniture has existed for a long time and includes, e.g., a chest of drawers, dressers, armoires, nightstands, accent chests, office furniture, dining furniture, and shelving units. Typical storage furniture includes a fixed rectangular frame structure in the form of a cabinet, and several drawers which may be individually drawn out from the cabinet in a horizontal direction. In such a structure, however, the center of gravity is high and tilt may occur due to climbs by children, opening of the drawers, or over-load at the upper drawers. This may cause instability in the furniture and hazards to safety of the users. Furniture tipping accidents have been on the rise.

Therefore, where a storage furniture exceeds a specific height, the concern of tip-over prevention needs to be considered. For example, the U.S. Consumer Product Safety Commission (CPSC) established a new mandatory furniture tip-over standard expected to go into effect in May of 2023 that requires any storage furniture that is 27 inches (about 68 cm) or more in height to meet certain stability requirements.

In an effort to avoid tip-over accidents, some products on the market currently offer the ability to attach the upper back of a piece of furniture, e.g., a dresser, to the wall or other vertical support behind the dresser so that the tipping is caught and restricted before the entire dresser falls forwards and causes an accident. However, some users may forego fastening the furniture to the wall or vertical support as being unnecessary since the furniture is able to stand freely without attachment. This failure to securely fasten the furniture to the wall or vertical support may cause instability and even non-compliance with applicable safety standards, which may increase the risk of furniture tip-over accidents.

In view of the problem mentioned, there is a need for an improved storage furniture with enhanced stability and reduced risk of tip-over accidents.

According to the present disclosure, there is provided an anti-tipping storage furniture, as set forth in the appended claims.

SUMMARY

An object of the present disclosure is to provide an improved tip-over prevention mechanisms that facilitate anchoring the storage furniture to a wall or vertical support.

Another object of the present disclosure is to provide a new and improved design configuration to reduce the likelihood of storage furniture from tipping over.

According to a first aspect, there is provided a storage frame with a frame including lateral sides (e.g., a pair of side panels), each with a back end and a front end opposing the back end. At least one drawer may be provided that is movable into and at least partly out of the frame when the at least one drawer is present in the frame. A fastener is configured to secure the frame to a vertical support (e.g., a wall) when the storage furniture is in an assembled orientation. The pair of side panels each have a top surface, and an opposing bottom surface in a facing relationship to a floor surface when in the assembled orientation. The bottom surface of the pair of side panels has a lesser front to back distance between the front end to the back end than the top surface.

The provision of sides or side panels of a frame with a bottom surface defining a lesser front to back distance than the top surface decreases the stability of the storage furniture when standing freely in an upright position on the floor surface by raising its center of gravity, which effectively forces a user to anchor the frame to the vertical support in the assembled orientation. Thereby, the likelihood of tip-over is reduced because the design of the frame necessitates its attachment to the vertical support for stability in the upright position.

Pursuant to an implementation, the front to back distance of the bottom surface is no more than approximately 50% (±5%) of the front to back distance of the top surface. With a bottom surface amounting to no more than approximately 50% of the top surface, the frame is provided with a narrow base of support that further motivates a user to secure the storage furniture to the vertical support via the fastener.

Additionally or alternatively, the lesser front to back distance may be provided by the front portion of the bottom surface being more rearward than the front portion of the top surface, which causes the storage furniture to rotate forwards without the provision of a fastener. In other words, when the frame is on the floor surface, the ability to rotate the frame forward of the vertical support from a first assembled orientation to a second assembled orientation is enhanced by the lower end having the lesser front to back distance than the upper end, and the frame is prevented from rotating from the first assembled orientation to the second assembled orientation when the fastener is connected to the vertical support.

Pursuant to an implementation, the back end of the pair of side panels each have a rear surface that abuts against the vertical support in the assembled orientation, and a notch is disposed in the rear surface at a lower end of the pair of side panels adjacent the bottom surface. The notch may accommodate floor runners or molding at the bottom of a wall to enable the back end of the frame to be flush with the wall.

Pursuant to an implementation, the front end of each side panel includes a first straight and elongate portion adjoining the top surface and extending at least generally vertically relative to the floor surface, and a second portion adjoining the bottom surface and extending rearwardly with respect to the first straight and elongate portion. Such a configuration provides the front portion of the bottom surface to be arranged rearwards of the front portion of the top surface, thereby providing a design that facilitates forward rotation of the storage furniture from an upright position in a freestanding state (i.e., without attachment to the vertical support) and thus necessitates its attachment to the vertical support via the fastener to reduce the likelihood of storage furniture from tipping over.

The second portion of the front end may extend straight and elongate at an angle from the first straight and elongate portion to the bottom surface to maximize a surface area of the front end when the frame is tipped from a first assembled orientation adjacent the vertical support and a second assembled orientation displaced from the vertical support. The second portion of the front end is thereby shaped/structured to provide stability in the second assembled orientation.

Additionally or alternatively, the top surface and the bottom surface extend parallel to one another, and wherein the second portion extends obliquely to the bottom surface and the first straight and elongate portion.

Pursuant to an implementation, the frame includes an upper horizontal panel and a lower horizontal panel, and the second portion is arranged below the lower horizontal panel relative to the floor surface when in the assembled orientation. Such a configuration further increases the likelihood of forward rotation from an upright position in a freestanding state (i.e., without attachment to the vertical support).

The at least one drawer may include a plurality of drawers movable into and at least partly out of the frame that are arranged between the upper horizontal panel and the lower horizontal panel. The second portion may be disposed below the bottommost one of the plurality of drawers. Such a configuration causes the storage furniture to be top-heavy, with a raised/heightened center of gravity, which increases the likelihood of forward rotation in a freestanding state.

The pair of side panels may each include at least one support foot disposed on the bottom surface. Additionally or alternatively, the pair of side panels extend over an entirety of a respective one of right and left lateral sides of the frame.

The fastener may be configured to secure the back end of the frame to the vertical support. For example, the fastener may comprise one or more brackets (e.g., an L-bracket or corner brace) that is fastened (e.g., via screws or bolts) to the frame (e.g., the side panels) and the vertical support. The bracket(s) may be provided on an interior of the frame (e.g., on an inside where the drawers are located) so as to be hidden from view, and/or on an exterior or outside of the frame.

Additionally or alternatively, the frame may include a back panel or inwardly projecting flange disposed between the back ends of the pair of side panels, and the fastener may comprise a screw or bolt that engages through an aperture in the back panel or flange and anchors into the vertical support.

According to a second aspect, there is provided a storage furniture assembly including a frame having an upper end and a lower end that rests on a floor surface in an assembled orientation, the lower end having a lesser front to back distance than the upper end. At least one drawer may be provided movable into and at least partly out of the frame when the drawer(s) is present in the assembled orientation. A fastener is provided that is configured to secure the frame to a vertical support (e.g., a wall). Whereby, when the frame is on the floor surface, the ability to rotate the frame forward of the vertical support from a first assembled orientation to a second assembled orientation is enhanced by the lower end having the lesser front to back distance than the upper end, and the frame is prevented from rotating from the first assembled orientation to the second assembled orientation when the fastener is connected to the vertical support. The lesser front to back distance of the lower end urges/necessitates anchoring the frame to the vertical support via the fastener to prevent forward rotation of the frame, thereby reducing the likelihood of tip-over accidents.

The frame includes two lateral sides extending from the lower end to the upper end. A lower portion of the two lateral sides may descend below a bottommost one of the at least one drawer with an open space therebetween.

Pursuant to an implementation, the lower portion of the two lateral sides decreases in front to back distance towards the lower end. Such a configuration provides the lateral sides with a bottom surface having a front portion that is more rearwards of a top surface of the lateral sides, which increases the likelihood of forward rotation of the frame in a freestanding state (i.e., without attachment).

The two lateral sides may each have an upper portion extending from the lower portion to the upper end with a generally constant front to back distance. Such a configuration causes the storage furniture to be top-heavy, with a raised/heightened center of gravity, which increases the likelihood of forward rotation in a freestanding state and thus forces users to use the fastener to secure the storage furniture to the vertical support.

The two lateral sides may each have a back end including a straight and elongate portion adjoining the upper end and extending vertically relative to the floor surface, and a notch adjoining the lower end.

Additionally or alternatively, the two lateral sides may each have a front end including a first straight and elongate portion adjoining the upper end and extending generally vertically relative to the floor surface, and a second straight and elongate portion adjoining the lower end and extending at an angle to the first straight and elongate portion to help stabilize the frame in the second assembled orientation.

Pursuant to an implementation, the frame includes an upper horizontal panel and a lower horizontal panel, and wherein the lower portion of the two lateral sides descends below the lower horizontal panel.

The upper horizontal panel may have the same front to back distance as the lower horizontal panel.

Pursuant to an implementation, the frame includes a back end with at least one aperture, and the fastener may comprise a screw or bolt received in the at least one aperture for securing the frame to the vertical support in the first assembled orientation and prevent the frame from rotating to the second assembled orientation. The back end, for example, may comprise a back panel extending between the two lateral sides, or an inwardly projecting flange extending from the respective lateral sides, where the back panel or flange(s) have the at least one aperture for receiving the screw or bolt.

Additionally or alternatively, the fastener comprises a bracket secured to the frame and the vertical support for securing the frame to the vertical support in the first assembled orientation and prevent the frame from rotating to the second assembled orientation. The bracket may comprise an L-shaped bracket or corner brace.

Other objectives, features and advantages of the present disclosure will appear from the following detailed disclosure, from the attached claims as well as from the drawings. Implementations of the disclosure may include combinations of the above-described features.

BRIEF DESCRIPTION OF THE DRAWINGS

While the claims are not limited to a specific illustration, an appreciation of various aspects may be gained through a discussion of various examples. The drawings are not necessarily to scale, and certain features may be exaggerated or hidden to better illustrate and explain an innovative aspect of an example. Further, the exemplary illustrations described herein are not exhaustive or otherwise limiting, and are not restricted to the precise form and configuration shown in the drawings or disclosed in the following detailed description. Exemplary illustrations are described in detail by referring to the drawings as follows:

DETAILED DESCRIPTION

Figure 1:
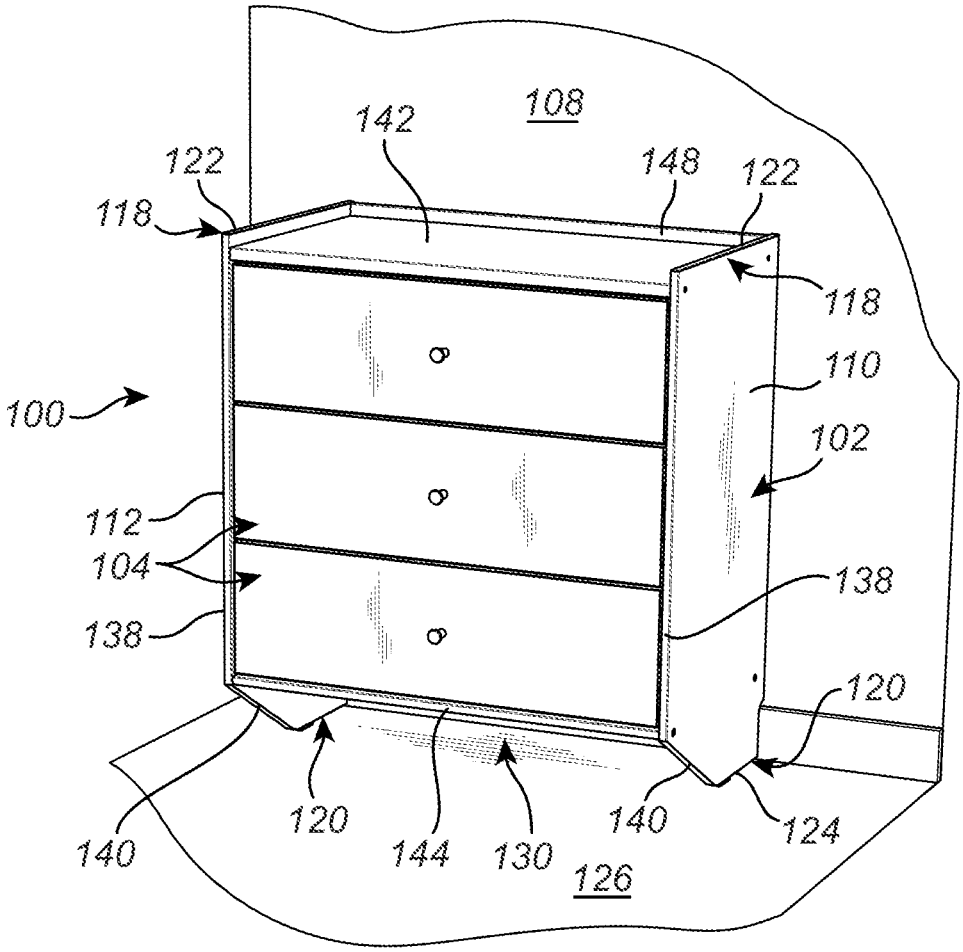
FIG. 1 is a perspective view of a storage furniture.

In the drawings, where like numerals and characters indicate like or corresponding parts throughout the several views, exemplary illustrates are shown in detail. The various features of the exemplary approaches illustrated and described with reference to any one of the figures may be combined with features illustrated in one or more other figures, as it will be understood that alternative illustrations that may not be explicitly illustrated or described may be able to be produced. The combinations of features illustrated provide representative approaches for typical applications. However, various combinations and modifications of the features consistent with the teachings of the present disclosure may be desired for particular applications or implementations.

Figure 2A:
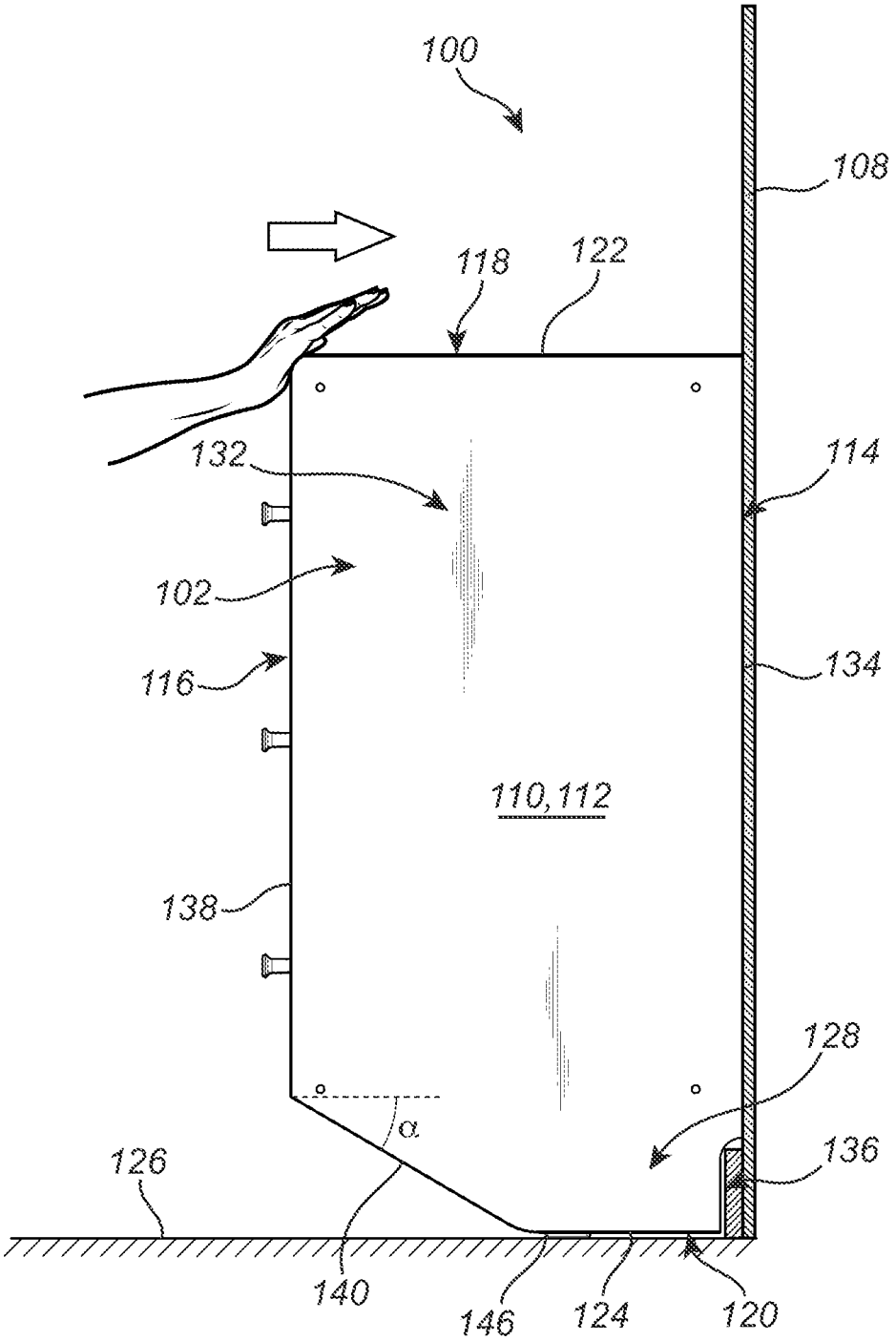
FIG. 2A is a side view of the storage furniture of FIG. 1 in a first assembled orientation adjacent to a vertical support.
Figure 2B:
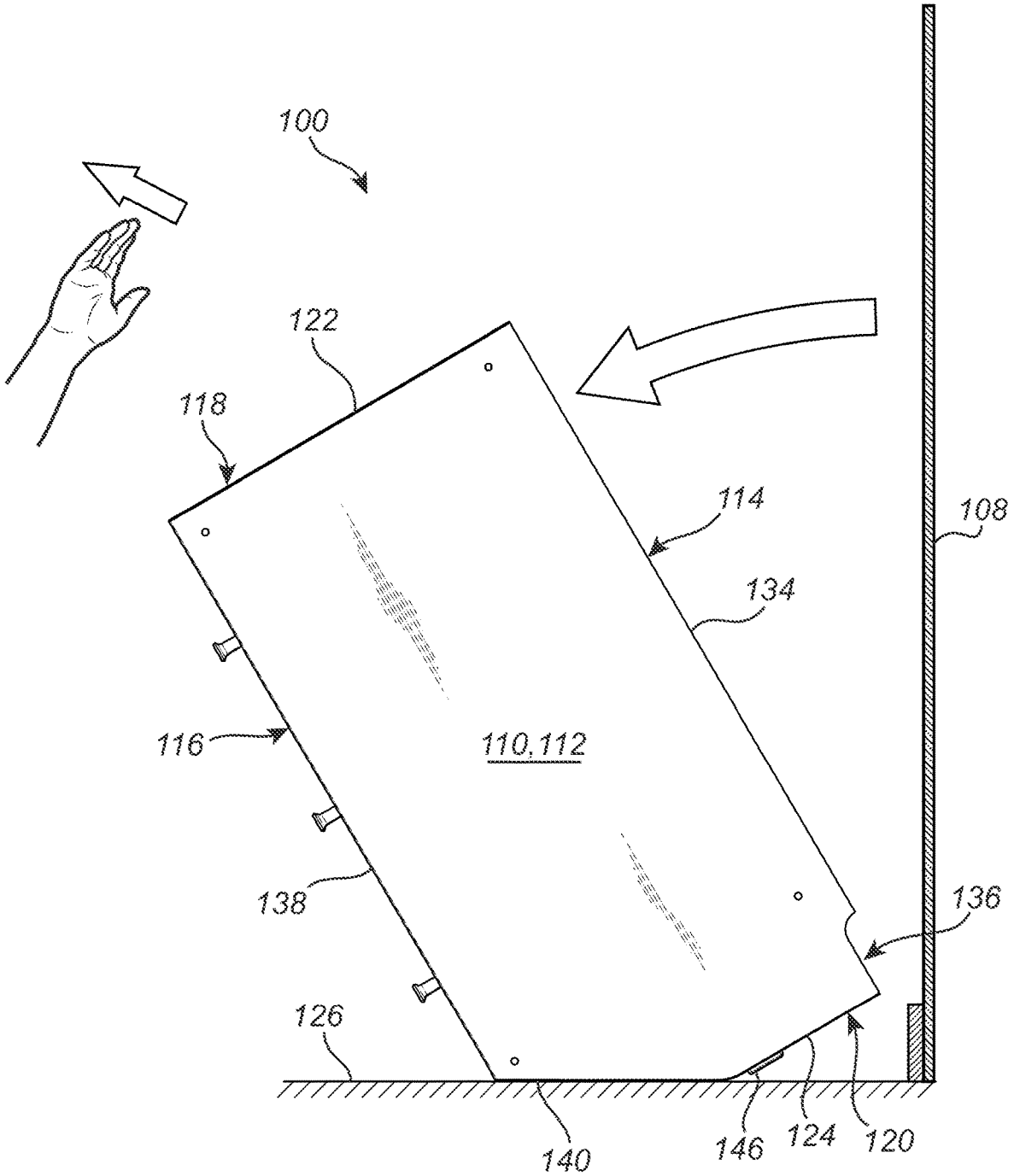
FIG. 2B is a side view of the storage furniture of FIG. 1 in a second assembled orientation displaced or rotated forward from the vertical support.
Figure 2C:
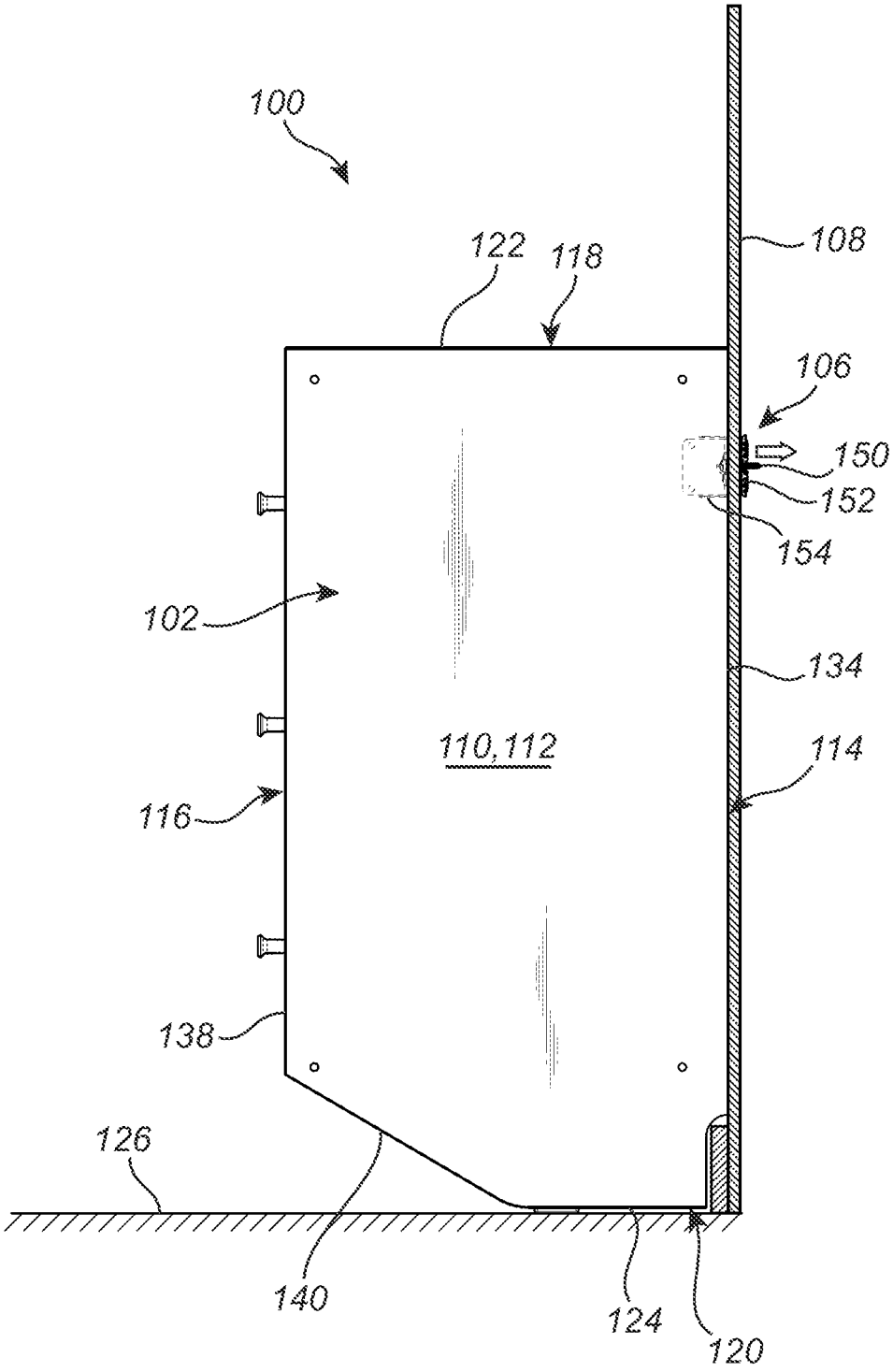
FIG. 2C is a side view of the storage furniture of FIG. 2A in the first assembled orientation with a fastener connected to the vertical support.

With reference to the drawings, FIGS. 1-2C show a storage furniture 100 according to an example. The storage furniture 100 is structured and designed to reduce the likelihood of storage furniture from tipping over by necessitating its attachment to a support structure through the provision of a narrow base depth in relation to its top, which facilitates forward rotation in a freestanding, upright position. Due to the tendency of the storage furniture 100 to forwardly rotation from a freestanding (unattached) upright position, a user is compelled to use the appropriate fastening mechanism to secure the storage furniture in position, thereby reducing the likelihood of tip-over accidents.

Referring to FIGS. 1 and 2C, the storage furniture 100 includes a frame 102, at least one drawer 104 movable into and at least partly out of the frame 102, and a fastener 106 configured to secure the frame 102 to a vertical support (e.g., a wall) 108. FIGS. 1 and 2C show the storage furniture in an assembled orientation or a first assembled orientation where the frame 102 is adjacent to the vertical support 108 and secured thereto via the fastener 106. The storage furniture 102 is shown as a dresser merely as an example for which the tip-over prevention mechanism may be integrated or incorporated, however it is contemplated that other types of furniture (e.g., office cabinets, nightstands, etc.) may be used without departing form the scope of the disclosure.

The frame 102 includes two lateral sides 110, 112, e.g., comprising side panels, each with a back end 114, a front end 116 opposing the back end 114, an upper end 118 with a top surface 122 and a lower end 120 with a bottom surface 124 arranged in facing relationship with a floor surface 126. The frame 102 is structured such that the lower end 120 has a lesser front to back distance than the upper end 118. Thereby, the bottom surface 124 defines a lesser front to back distance between the front end 116 and the back end 114 than the top surface 122. For example, the front to back distance of the bottom surface 124 may be no more than approximately 50% (±5%) of the front to back distance of the top surface 122.

The two lateral sides 110, 112 extend from the upper end 118 to the lower end 120 on the left and right sides of the storage furniture 100 and may each comprise a side panel. The side panel may comprise a single piece of material, e.g., extending from the front end 116 to the back end 114 over an entirety of a respective one of lateral sides 110, 112, although it is contemplated that other structural configurations for the lateral sides 110, 112 may be used (e.g., with front and rear vertical supports interconnected by upper and lower supports). As referred to herein, the terms lateral sides may be used interchangeably with side panels.

The at least one drawer 104 may comprise a plurality of drawers 104 movable into and at least partly out of the frame 102, e.g., via a sliding/guiding mechanism. The drawers 104 may have a generally consistent width (left to right), depth (front to back), and height (top to bottom), although it is contemplated that drawers of varying width, depth, and/or height may be used without departing form the scope of the disclosure. Additionally, it is contemplated that the storage furniture may be provided with shelves instead of movable drawers without departing from the scope of the disclosure.

A lower portion 128 of the frame 102 or respectively of the lateral sides 110, 112 descends below a bottommost drawer 104 with an open space 130 therebetween. The lower portion 128 extends to the lower end 120 and decreases in front to back distance towards the lower end 120. An upper portion 132 of the lateral sides 110, 112 extends from the lower portion 128 to the upper end 118 and may have a generally constant front to back distance. Thereby, a front portion of the lower end 120 or respectively the bottom surface 124 is disposed more rearwards than a front portion of the upper end 118 or respectively the top surface 122. For example, the front portion of the bottom surface 124 may end at a geometric center or central longitudinal plane of the frame 102, as measured from the front to back distance of the upper portion 132. As such, forward rotation or tipping is facilitated when the frame 102 is in a freestanding upright position, thereby necessitating its attachment to the vertical support 108 via fastener(s) 106.

The lateral sides 110, 112 have a rear surface 134 on the back end 114 that is adjacent to, and in certain circumstances abuts against, the vertical support 108 in the first assembled orientation. The rear surface 134 may define a straight and elongate portion adjoining the upper end 118 and extending vertically relative to the floor surface 126, and a notch 136 adjoining the lower end 120. The notch 136 accommodates floor runners or moldings, e.g., on a wall, so that the rear surface 134 can abut against the wall and facilitate fastening the storage furniture 100 to the vertical support 108 in the first assembled orientation.

The front end 116 of the lateral sides 110, 112 includes a first portion 138 that may be straight and elongate, which adjoins the upper end 118 or respectively the top surface 122 and extends at least generally vertically relative to the floor surface 126. Although the first portion 138 is shown and referred to as straight and elongate, it is contemplated that other shapes may be used such as curved without departing from the scope of the disclosure. The front end 116 further includes a second portion 140 adjoining the lower end 120 or respectively the bottom surface 124 and extending rearwardly with respect to the first straight and elongate portion 138. For example, the second portion 140 may extend obliquely to the bottom surface 124 and the first straight and elongate portion 138, where the bottom surface 124 and the top surface 122 extend parallel to one another (e.g., horizontally).

An upper horizontal panel 142 may be disposed towards the top surface 122 of the frame 102 and a lower horizontal panel 144 may be disposed towards the bottom surface 124 of the frame 102. The upper horizontal panel 142 and the lower horizontal panel 144 may have the same depth or front to back distance to one another, and the drawers 104 may be arranged between the upper and lower horizontal panels 142, 144. The lower horizontal panel 144 may define a virtual demarcation between the upper portion 132 and the lower portion 128 of the frame 102. More specifically, the lower horizontal panel 144 may be disposed between the lateral sides 110, 112 at a transition between the first straight and elongate portion 138 and the second portion 140, so that the lower portion 128 descends below the lower horizontal panel 144 to at least partially define the open space 130 underneath the bottommost drawer 104. The second portion 140 is arranged below the lower horizontal panel 144 relative to the floor surface 126 in the assembled orientation and extends rearwardly from the first straight and elongate portion 138 to the lower end 120.

The lower end 120 of the lateral sides 110, 112 may comprise one or more support feet 146 or legs on the bottom surface 124 that rest on the floor surface 126. As more clearly shown in FIGS. 2A and 2B, the lower end 120 of each lateral side 110, 112 has a single support foot 146 on the bottom surface 124 disposed closer to the front end 116 than the back end 114 to help position the upper end 118 against the support structure 108 in the assembled orientation.

With continued reference to FIGS. 2A and 2B, FIG. 2A shows the storage furniture 100 in a first assembled orientation where the frame 102 is in an upright position with the rear surface 134 of the back end 114 adjacent to and abutting the vertical support 108. FIG. 2B shows the storage furniture 100 in a second assembled orientation that is displaced from the vertical support 108 where the frame 102 is rotated forward of the vertical support 108. The lower portion 128 enhances the ability of the frame 102 to rotate forward of the vertical support 108 by the bottom surface 124 or respectively lower end 120 having the lesser front to back distance than the top surface 122 or respectively upper end 114, when the frame 102 is on the floor surface 126 and freestanding (unattached) to the vertical support 108.

Further, the second portion 140 may extend straight and elongate at an angle $\alpha$ from the first straight and elongate portion 138 to the bottom surface 124 to maximize a surface area of the front end 116 of the lower portion 128 when the frame 102 is rotated forward or tipped from the first assembled orientation (FIG. 2A) adjacent the vertical support 108 and the second assembled orientation (FIG. 2B) displaced from the vertical support 108. The second portion 140, extending straight and elongate at an angle $\alpha$ to the first straight and elongate portion 138, helps stabilize the frame 102 in the second assembled orientation. Pursuant to an implementation, the angle $\alpha$ ranges between approximately 30° to 60° (±5°), with the illustrated example having an angle $\alpha$ of approximately 45° (±5°), to provide sufficient stability for the frame 102 in the second assembled orientation.

Accordingly, when the frame 102 is on the floor surface 126, the ability to rotate the frame 102 forward of the vertical support 108 from the first assembled orientation (FIG. 2A) to the second assembled orientation (FIG. 2B) is enhanced by the lower end 120 having the lesser front to back distance than the upper end 118, e.g., when the frame 102 is in a freestanding (unattached) state. The second portion 140 is configured (e.g., through its structure and angle $\alpha$ relative to the first portion 138) to help stabilize the frame 102 in the second assembled orientation (FIG. 2B). The frame 102 is prevented from rotating from the first assembled orientation (FIG. 2A) to the second assembled orientation (FIG. 2B) when the fastener 106 (see FIG. 2C) is connected to the vertical support 108.

Referring to FIG. 2C, the fastener 106 secures the back end 114 of the frame 102 to the vertical support 108 in the first assembled orientation and prevents the frame 102 from rotating from the first assembled orientation to the second assembled orientation (see FIG. 2B) when the fastener 106 is connected to the vertical support 108. The fastener 106 may comprise a variety of mechanisms used to secure furniture to a vertical support 108 such as a wall. For example, the frame 102 may comprise a back panel 148 extending between the back ends 114 of the lateral sides 110, 112 that has one or more apertures 152 structured and arranged to receive a screw or bolt 150 that anchors into the vertical support 108. The back panel 148 may extend only partially between the upper and lower horizontal panels 142, 148 (e.g., horizontally elongate), extend entirely over the back end 114 from the upper end 122 or upper horizontal panel 142 to at least the lower horizontal panel 144 or even the lower end 120 in certain situations. Alternatively, the back panel may instead be replaced by an inwardly projecting flange extending inwardly form one or both lateral sides 110, 112, which flange(s) has one or more apertures 152 for receiving a screw or bolt 152. Additionally or alternatively, the fastener 106 may comprise one or more brackets 154 (e.g., an L-bracket or corner brace) that is secured (e.g., via bolts/screws received in apertures) to the frame 102 and the vertical support 108. The bracket(s) 154 may be positioned on the inside of the frame 102 as shown in FIG. 2C so as to be hidden from view, or positioned on the outside to facilitate easy mounting.

Unlike traditional dressers and the like, the storage furniture 100 of the present disclosure utilizes a unique frame 102 that is structured/shaped to necessitate its attachment to a wall or other vertical support through the provision of a bottom surface 124/lower end 120 having a lesser front to back distance than a top surface 122/upper end 118, which forms a narrow support base (in terms of depth) that creates instability causing the storage furniture to tip or forwardly rotate unless the frame 102 is secured to the vertical support 108 via a fastener 106. A forwardmost surface of at least one drawer 104 (e.g., a front surface of the front panel of the drawer), and in the illustrated example the forwardmost surface of all of the drawers 104, is more forward than a front portion of the bottom surface 124/lower end 120 when the drawer(s) 104 is closed, causing an imbalance and instability that urges the frame to forwardly rotate when in a freestanding upright position (first assembled orientation), thereby compelling a user to fasten the frame 102 to the vertical support to prevent the forward rotation to the second assembled orientation and reduce the likelihood of tip-over accidents. The structure of the lower portion 128, e.g., the second portion 140 extending rearwardly and obliquely from the first portion 138, maximizes a surface area of the front end 116 to enhance stability in the second assembled orientation.

Various examples/embodiments are described herein for various articles and/or assemblies. Numerous specific details are set forth to provide a thorough understanding of the overall structure, function, manufacture, and use of the examples/embodiments as described in the specification and illustrated in the accompanying drawings. It will be understood by those skilled in the art, however, that the examples/embodiments may be practiced without such specific details. In other instances, well-known operations, components, and elements have not been described in detail so as not to obscure the examples/embodiments described in the specification. Those of ordinary skill in the art will understand that the examples/embodiments described and illustrated herein are non-limiting examples, and thus it can be appreciated that the specific structural and functional details disclosed herein may be representative and do not necessarily limit the scope of the embodiments.

Accordingly, even though the present disclosure has been described in detail with reference to specific examples, it will be appreciated that the various modifications and changes can be made to these examples without departing from the scope of the present disclosure as set forth in the claims. It is anticipated and intended that future developments will occur in the technologies discussed herein, and that the disclosed article and/or assembly will be incorporated into such future developments. Thus, the specification and the drawings are to be regarded as an illustrative thought instead of merely restrictive thought.

With respect to the foregoing discussion, it is noted that specific directional conventions are assumed to be known to those skilled in the art. In this context, the term "front" (or its equivalents) refers to drawer side of the storage furniture. Thus, the term "back" refers to the rear of the storage furniture, opposite to the front and typically facing a wall or other vertical support.

Additionally, the term "longitudinal" refers to the longitudinal axis of the storage furniture 100 that extends from the upper end 116 to the lower end 120 of the frame 102. The central longitudinal axis provides directional relationship for the terms "axially" (or its equivalents) and "radially" (or its equivalents). For example, "radially" or "radial direction" extends transversely to the longitudinal axis.

Reference throughout the specification to "examples, "in examples," "with examples," "various embodiments," "with embodiments," "in embodiments," or "an embodiment," or the like, means that a particular feature, structure, or characteristic described in connection with the example/embodiment is included in at least one embodiment. Thus, appearances of the phrases "examples, "in examples," "with examples," "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more examples/embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or nonfunctional. Moreover, many modifications may be made to adapt a particular situation or material to the teachings of the present disclosure without departing from the scope thereof.

It should be understood that references to a single element are not necessarily so limited and may include one or more of such element. Further, all numbers expressing dimensions, ratios and the like, used in the specification and claims, are to be understood to encompass tolerances and other deviations as represented by the term "about" or "approximately." Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of examples/embodiments.

Joinder references (e.g., attached, coupled, connected, and the like) are to be construed broadly and may include intermediate members between a connection of elements, relative movement between elements, direct connections, indirect connections, fixed connections, movable connections, operative connections, indirect contact, and/or direct contact. As such, joinder references do not necessarily imply that two elements are directly connected/coupled and in fixed relation to each other. Connections of electrical components, if any, may include mechanical connections, electrical connections, wired connections, and/or wireless connections, among others. The use of "e.g." in the specification is to be construed broadly and is used to provide nonlimiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are inclusive unless such a construction would be illogical.

All matter contained in the above description or shown in the accompanying drawings shall be interpreted as illustrative only and not limiting. Changes in detail or structure may be made without departing from the present disclosure.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary. Further, the use of "at least one of" is intended to be inclusive, analogous to the term and/or. As an example, the phrase "at least one of A, B and C" includes A only, B only, C only, or any combination thereof (e.g. AB, AC, BC or ABC). Additionally, use of adjectives such as first, second, etc. should be read to be interchangeable unless a claim recites an explicit limitation to the contrary.

What is claimed is:

1. A storage furniture, comprising:

a frame including a pair of side panels, each with a back end and a front end opposing the back end;

at least one drawer movable into and at least partly out of the frame when the at least one drawer is present in the frame;

a fastener configured to secure the frame to a vertical support when in an assembled orientation; and wherein the pair of side panels each have a top surface, and an opposing bottom surface in a facing relationship to a floor surface when in the assembled orientation, and wherein the bottom surface has a lesser front to back distance between the front end to the back end than the top surface;

wherein the front end of each side panel includes a first straight and elongate portion adjoining the top surface and extending at least generally vertically relative to the floor surface, and a second portion adjoining the bottom surface and extending rearwardly with respect to the first straight and elongate portion; and wherein the top surface and the bottom surface extend parallel to one another, and wherein the second portion extends obliquely to the bottom surface and the first straight and elongate portion.

2. The storage furniture of claim 1, wherein the back end of the pair of side panels each have a rear surface that abuts against the vertical support in the assembled orientation, and wherein a notch is disposed in the rear surface at a lower end of the pair of side panels adjacent the bottom surface.

3. The storage furniture of claim 1, wherein the second portion extends straight and elongate at an angle from the first straight and elongate portion to the bottom surface to maximize a surface area of the front end when the frame is tipped from a first assembled orientation adjacent the vertical support and a second assembled orientation displaced from the vertical support.

4. The storage furniture of claim 1, wherein the frame further includes an upper horizontal panel and a lower horizontal panel, and wherein the second portion is arranged below the lower horizontal panel relative to the floor surface when in the assembled orientation.

5. The storage furniture of claim 4, wherein the at least one drawer includes a plurality of drawers arranged between the upper horizontal panel and the lower horizontal panel, and wherein the second portion is disposed below a bottommost one of the plurality of drawers.

6. The storage furniture of claim 1, wherein at least one of:

the pair of side panels each include at least one support foot disposed on the bottom surface; and the pair of side panels extend over an entirety of a respective one of right and left lateral sides of the frame.

7. The storage furniture of claim 1, wherein the frame includes a back panel extending between the back ends of the pair of side panels, and wherein the fastener includes a screw or bolt that engages through an aperture in the back panel and anchors into the vertical support.

8. The storage furniture of claim 1, wherein the front to back distance of the bottom surface is no more than approximately 50% of the front to back distance of the top surface.

9. A storage furniture assembly, comprising:

a frame having an upper end and a lower end that rests on a floor surface in an assembled orientation, the lower end having a lesser front to back distance than the upper end;

at least one drawer movable into and at least partly out of the frame when present in the assembled orientation;

a fastener configured to secure the frame to a vertical support;

whereby when the frame is on the floor surface, the ability to rotate the frame forward of the vertical support from a first assembled orientation to a second assembled orientation is enhanced by the lower end having the lesser front to back distance than the upper end, and wherein the frame is prevented from rotating from the first assembled orientation to the second assembled orientation when the fastener is connected to the vertical support;

wherein the frame includes two lateral sides extending from the lower end to the upper end, and wherein a lower portion of the two lateral sides descends below a bottommost one of the at least one drawer with an open space therebetween;

wherein the two lateral sides each have a front end including a first straight and elongate portion adjoining the upper end and extending generally vertically relative to the floor surface, and a second straight and elongate portion adjoining the lower end and extending at an angle to the first straight and elongate portion to help stabilize the frame in the second assembled orientation.

10. The storage furniture assembly of claim 9, wherein the lower portion of the two lateral sides decreases in front to back distance towards the lower end.

11. The storage furniture assembly of claim 10, wherein the two lateral sides each have an upper portion extending from the lower portion to the upper end with a generally constant front to back distance.

12. The storage furniture assembly of claim 9, wherein the two lateral sides each have a back end including a straight and elongate portion adjoining the upper end and extending vertically relative to the floor surface, and a notch adjoining the lower end.

13. The storage furniture assembly of claim 9, wherein the frame includes an upper horizontal panel and a lower horizontal panel, and wherein the lower portion of the two lateral sides descends below the lower horizontal panel.

14. The storage furniture assembly of claim 13, wherein the upper horizontal panel has the same front to back distance as the lower horizontal panel.

15. The storage furniture assembly of claim 9, wherein the frame includes a back end with at least one aperture, and wherein the fastener comprises a screw or bolt received in the at least one aperture for securing the frame to the vertical support in the first assembled orientation and prevent the frame from rotating to the second assembled orientation.

16. The storage furniture assembly of claim 9, wherein the fastener includes a bracket secured to the frame and the vertical support for securing the frame to the vertical support in the first assembled orientation and prevent the frame from rotating to the second assembled orientation.

* * * * *